US005472929A

United States Patent [19]

Inoue et al.

[11] Patent Number: 5,472,929

[45] Date of Patent: Dec. 5, 1995

[54] REVERSIBLE HEAT-SENSITIVE RECORDING MEDIUM AND MAGNETIC CARD USING THE SAME

[75] Inventors: Yasushi Inoue; Yoshihiro Hieda; Masaaki Kishimoto, all of Osaka, Japan

[73] Assignee: Nitto Denko Corporation, Osaka, Japan

[21] Appl. No.: 281,687

[22] Filed: Jul. 28, 1994

[51] Int. Cl.[6] ..... B41M 5/035; B41M 5/38

[52] U.S. Cl. ..... 503/204; 502/201; 502/206; 502/226

[58] Field of Search ..... 503/201, 217, 503/226, 204, 206; 428/694; 427/152

[56] References Cited

FOREIGN PATENT DOCUMENTS 5-38881 6/1993 Japan ..... 503/201

*Primary Examiner*—B. Hamilton Hess

*Attorney, Agent, or Firm*—Sughrue, Mion, Zinn, Macpeak & Seas

[57] ABSTRACT

A reversible heat-sensitive recording medium comprising a reversible heat-sensitive recording layer containing a resin matrix and an organic low molecular weight material, and an overcoat layer, wherein an intermediate layer comprising an ultraviolet ray-crosslinkable or electron beam-crosslinkable resin as a main component is provided between the reversible heat-sensitive recording layer and the overcoat layer.

14 Claims, 1 Drawing Sheet

FIGURE
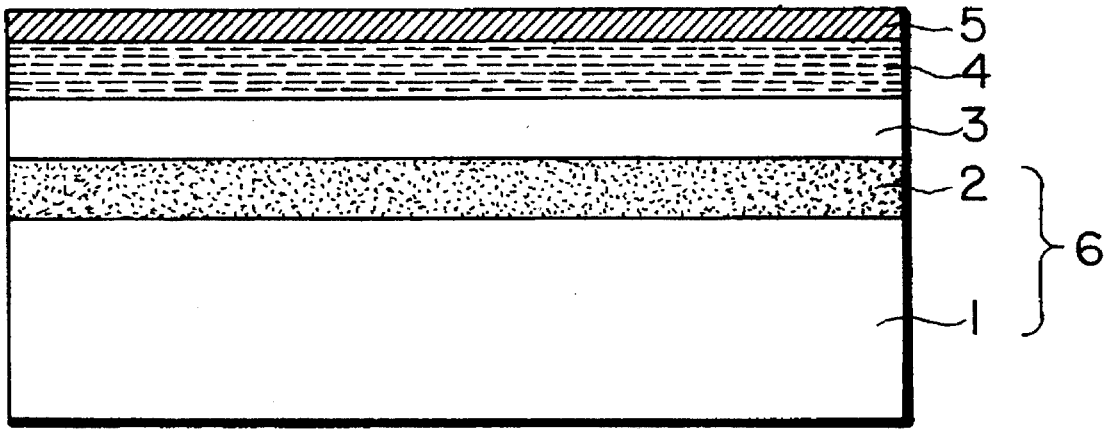

REVERSIBLE HEAT-SENSITIVE RECORDING MEDIUM AND MAGNETIC CARD USING THE SAME

FIELD OF THE INVENTION

The present invention relates to a reversible heat-sensitive recording medium which can reversibly repeat to form and erase an image based on a temperature change. The reversible heat-sensitive recording medium of the present invention can be used as a magnetic card.

BACKGROUND OF THE INVENTION

In recent years, a progress in a thermal head is accompanied with utilization of a heat-sensitive recording material which has rapidly been expanding. In particular, in a prepaid card which is rapidly getting popular in the fields of communication, transportation and distribution, a magnetic information is displayed on a card face as a visible information in many cases. Such the magnetic card is widely used as a highway card, a JR Orange card, or a prepaid card in a department store and a super market. However, an area in which the visible information can be expressed on such the magnetic card is limited, and in case of an expensive prepaid card, successive recording of the balances thereof leads to impossibility to display the information in some cases. In such the case, a new card is usually reissued to cope therewith, which involves a problem that a cost is increased.

In order to overcome such problems, a reversible recording material in which recording and erasing can be conducted plural times on the same area is preferably used. Use of such the material makes it possible to erase an old information and display a new information and therefore, it is not necessary to reissue a new card due to impossibility of displaying the informations.

There have so far been proposed as such a heat-sensitive recording material as can reversibly record and erase the informations, materials having a heat-sensitive recording layer in which an organic low molecular organic substance such as higher alcohol and higher fatty acid is dispersed in a resin matrix such as polyvinyl chloride, a vinyl chloride-vinyl acetate copolymer, polyester, and polyamide [JP-A-54-119377 (the term "JP-A" as used herein means an unexamined published Japanese patent application), JP-A-55-154198 and JP-A-2-1363].

Formation and erasion of an image with such the material is carried out by utilizing a reversible change in a transparency in a heat-sensitive recording layer by a temperature. That is, this recording material shows a transparent state at some temperature ($t_1$ to $t_1'$, provided that $t_1<t_1'$) and shows a white turbid state at a temperature higher than $t_1'$. Where the recording layer is provided on the magnetic card, a thermal head is particularly preferred to heat the recording layer. That is, a transparent state is set at an initial stage and that portion is then turned white turbid by heating to a temperature higher than ($t_1'$) with a thermal head to record a character and a pattern. Alternatively, a while turbid state may be set at the initial stage and that portion may be then turned transparent by heating to a temperature ($t_1$ to $t_1'$) with the thermal head for recording. In erasing them, it is heated to a temperature of ($t_1$ to $t_1'$) in a former case and to a temperature of ($t_1'$) or higher in a latter case with a heat roll or a thermal head.

However, repeated printing on the same place of the heat-sensitive recording layer with the thermal head transforms the heat-sensitive recording layer by heat and pressure of the thermal head and makes white turbidity incomplete to deteriorate a printability. In order to overcome such problems, an overcoat layer is provided on the heat-sensitive recording layer but repeated exertion of severe heat and pressure stresses to the same place allows the heat-sensitive recording layer to peel off from the overcoat layer. In order to cope therewith, it is proposed to provide an intermediate layer which improves the adhesiveness thereof between the heat-sensitive recording layer and the overcoat layer. However, even such the heat-sensitive recording medium cannot sufficiently endure a severe stress in printing.

SUMMARY OF THE INVENTION

One object of the present invention is to provide a reversible heat-sensitive recording medium which has an excellent durability against a stress in printing and an excellent resistance to solvent in forming an overcoat layer and which shows good appearance and printability.

Another object of the present invention is to provide a magnetic card using the reversible heat-sensitive recording medium.

As a result of various investigations to overcome the above-described problems, it has been found that an excellent adhesiveness can be obtained by using an ultraviolet ray-crosslinkable or electron beam-crosslinkable resin layer as an intermediate layer provided between a heat-sensitive layer and an overcoat layer. The present invention has been completed based on this finding.

The reversible heat-sensitive recording medium according to the present invention comprises a reversible heat-sensitive recording layer containing a resin matrix and an organic low molecular weight material, and an overcoat layer, wherein an intermediate layer comprising an ultraviolet ray-crosslinkable or electron beam-crosslinkable resin as a main component is provided between the reversible heat-sensitive recording layer and the overcoat layer.

The magnetic card according to the present invention comprises a magnetic card member having provided thereon the reversible heat-sensitive recording medium.

An information can repeatedly be recorded and erased on the heat-sensitive recording layer in the recording medium of the present invention and visual recording can be carried out on the heat-sensitive recording layer with a heating recording device such as a thermal head. Further, reloading and renewal of an information in which the information is readily erased and recorded are possible with the same device.

In the reversible heat-sensitive recording medium of the present invention, a magnetic card member having a magnetic recording layer provided on the surface thereof is particularly preferably used as a substrate. In this case, a reversible heat-sensitive recording layer may be provided either on a magnetic layer provided on the surface of the substrate or the reverse face thereof. Further, it may be provided either on a full face of the substrate or at a part thereof.

BRIEF DESCRIPTION OF THE DRAWING

The attached FIGURE is a schematic cross-sectional view showing one example of the magnetic card using the reversible heat-sensitive recording medium of the present invention.

DETAILED DESCRIPTION OF THE INVENTION

The reversible heat-sensitive recording medium and the magnetic card using the same of the present invention will be explained by reference to the accompanying drawing.

The attached FIGURE is a schematic cross-sectional view showing one example of the magnetic card comprising a substrate having coated on the surface thereof a magnetic recording layer, and a reversible heat-sensitive recording layer provided on the magnetic recording layer.

In the FIGURE, the magnetic recording layer 2 is provided on one face of the card member 1 to form a magnetic card member (substrate) 6. A heat-sensitive recording layer 3 which enables an information to reversibly be recorded and erased is provided on the magnetic recording layer 2. The heat-sensitive recording layer 3 contains a resin matrix and an organic low molecular weight material which is dispersed therein. An overcoat layer 5 is provided on the heat-sensitive recording layer 3 via an intermediate layer 4.

The resin matrix used for the reversible heat-sensitive recording layer in the recording medium of the present invention forms a layer in which an organic low molecular weight material is uniformly dispersed and maintained and greatly affects a degree of transparency at a maximum transparence. Therefore, the resin matrix preferably is a resin having a good transparency, a mechanical stability and an excellent film formability. Examples of such the resin are a thermoplastic resin such as a vinyl chloride copolymer (e.g., polyvinyl chloride, a vinyl chloride-vinyl acetate copolymer, a vinyl chloride-vinyl acetate-vinyl alcohol copolymer, or a vinyl chloride-acrylate copolymer); a vinylidene chloride copolymer (e.g., polyvinylidene chloride, a vinylidene chloride-vinyl chloride copolymer, or a vinylidene chloride-acrylonitrile copolymer); a polyvinyl acetal resin (e.g., polyester, polyamide, polyvinyl formal, or polyvinyl butyral); an acrylic resin (e.g., polyacrylate, polymethacrylate, or an acrylate-methacrylate copolymer); a silicone resin; a polystyrene; a styrene-butadiene copolymer; a polyacrylate; a polycarbonate; a polysulfone; an aromatic polyamide; a phenoxy resin; or a cellulose resin; and other thermosetting resins. Those resin matrixes can be used alone or as mixtures thereof.

The organic low molecular weight material which is blended with the heat-sensitive recording layer is a higher fatty acid, particularly at least one of higher fatty acids having 16 or more carbon atoms. Examples of such higher fatty acids having 16 or more carbon atoms include palmitic acid, margaric acid, steraric acid, nonadecanoic acid, eicosanoic acid, heneicosanoic acid, behenic acid, lignoceric acid, pentacosanoic acid, cerotic acid, heptacosanoic acid, montanoic acid, triacontanoic acid, nonacosanoic acid, melissic acid, 2-heptadecenoic acid, 2-hexadecenoic acid, trans-3-hexadecenoic acid, trans-2-octadecenoic acid, cis-2-octadecanoic aicd, trans-4-octadecenoic acid, cis-6-octadecenoic acid, elaidic acid, baseninoic acid, trans-gondoinoic acid, erucic acid, brassidic acid, ceracoleic acid, trans-ceracoleic acid, trans-8-octadecadienoic acid, trans-10-octadecadienoic acid, linoelaidic acid, a-eleostearic acid, b-eleostearic acid, pseudoeleostearic acid, and 12,20-heneicosadienoic acid. Those can be used alone or as mixtures thereof.

It is preferred for the organic low molecular weight material to use a sulfide represented by a formula: $HOOC(CH_2)_m—S—CH_2)_nCOOH$ wherein m and n each represents an integer of 1 to 5, in combination with the higher fatty acid described above. Combined use of the sulfide with the higher fatty acid having 16 or more carbon atoms can achieve shift of a transparent temperature region to a higher temperature side and also expansion of the region width thereof. Examples of the sulfide are (1,1'-dicarboxy-)dimethylsulfide, (2,2'-dicarboxy)diethylsulfide (thiodipropionic acid), (3,3'-dicarboxy)dipropylsulfide, (1,2'-dicarboxy)-methylethylsulfide, (1,3'-dicarboxy)methylpropylsulfide, (1,4'-dicarboxy)methylbutylsulfide, (2,3'-dicarboxy)-ethylpropylsulfide, (2,4'-dicarboxy)ethylbutylsulfide, and (5,5'-dicarboxy)dipentylsulfide. Those can be used alone or as mixtures thereof.

The proportion of the higher fatty acid to the sulfide such as thiodipropionic acid is 90:10 to 10:90, preferably 90:10 to 30:70, by a weight ratio. If the proportion of the sulfide used is less than the above range, the expansion of the transparent temperature width is insufficient. On the other hand, if the proportion of the sulfide used is more than the above range, a contrast is decreased.

The proportions of the organic low molecular weight material and the resin matrix contained in the heat-sensitive recording layer are that the amount of the resin matrix is from 50 to 1,600 parts by weight, and preferably from 100 to 500 parts by weight, per 100 parts by weight of the organic low molecular weight material. If the amount of the resin matrix used is less than 50 parts by weight, it becomes difficult to form a film in which the organic low molecular weight material is stably maintained in the resin matrix. On the other hand, if the amount of the resin matrix exceeds 1,600 parts by weight, written recorded informations cannot be clearly read due to a small amount of the organic low molecular weight material which turns white turbid, and thus, such is not preferred as a recording material. It is preferred that the organic low molecular weight materials are uniformly dispered in and also sufficiently fixed with the resin matrix. The organic low molecular weight material may be partially compatibilized with the resin matrix.

Various additives such as a lubricant, an anti-static agent, a plasticizer, a dispersant, a stabilizer, a surface active agent, and an inorganic or organic filler may be added to the reversible heat-sensitive recording layer, if required and necessary.

A solvent used to form the heat-sensitive recording layer is appropriately selected according to the kinds of the resin matrix and the organic low molecular weight material. Examples of the solvent are tetrahydrofuran, methyl ethyl ketone, methyl isobutyl ketone, chloroform, carbon tetrachloride, ethanol, toluene, and benzene. Not only in the case that a dispersion is used but also in the case that a solution is used, the organic low molecular weight material is precipitated as fine particles and is present in a dispersed state in the heat-sensitive recording layer obtained.

A film thickness of the heat-sensitive recording layer varies depending on the purpose of use thereof, but is generally from 1 to 20 μm. If the thickness of the heat-sensitive recording layer is larger than 20 μm, it becomes difficult to transmit heat from a thermal head, and if the thickness thereof is less than 1 mm, a contrast (white turbidity) undesirably decreases. There is no film thickness limitation where a heating means other than the thermal head is used.

The intermediate layer provided on the heat-sensitive recording layer comprises a UV ray-crosslinkable or electron beam-crosslinkable resin as a main component. An oligomer and a monomer are generally used to form the ultraviolet ray-crosslinkable or electron beam-crosslinkable resin.

The oligomer used is a conventional compound such as urethane acrylate, epoxy acrylate, polyester acrylate, polybutadiene acrylate, and melamine acrylate, each having a weight average molecular weight of 500 to 3000. Of those oligomers, polyester acrylate is particularly preferred from the standpoint of an adhesiveness to the overcoat layer. Those oligomers can be used alone or in combination of two or more thereof.

The monomer used is di(meth)acrylate containing a long-chain alkylene group having 4 to 10 carbon atoms in one molecule. Examples of the monomer are ethylene glycol di(meth)acrylate, diethylene glycol di(meth)acrylate, triethylene glycol di(meth)acrylate, tetraethylene glycol di(meth)acrylate, propylene glycol di(meth)acrylate, tetrapropylene glycol di(meth)acrylate, 1,4-butanediol di(meth)acrylate, di(tetramethylene glycol) di(meth)acrylate, 1,5-pentanediol di(meth)acrylate, 1,6-hexanediol di(meth)acrylate, 3-methyl-1,5-pentanediol di(meth)acrylate, 1,9-nonanediol di(meth)acrylate, 1,9-decanediol di(meth)acrylate, and the isomers thereof. Those monomers can be used alone or in combination of two or more thereof. Of those monomers, 1,9-nonanediol di(meth)acrylate is particularly preferred from the standpoints of a repeated use characteristic and an adhesiveness to a reversible heat-sensitive recording layer.

The proportions of the oligomer (A) used and the monomer (B) used are that (A)/(B) is 90/10 to 10/90, and preferably 40/60 to 20/80, by weight ratio. If the amount of the oligomer (A) exceeds 90 parts by weight per 100 parts by weight of (A)+(B), adhesiveness of the intermediate layer to the reversible heat-sensitive recording material layer decreases and an appearance tends to deteriorate when printing and erasing are repeated. On the other hand, if the amount of the monomer (B) exceeds 90 parts by weight per 100 parts by weight of (A)+(B), a curing property undesirably decreases.

A photopolymerization initiator is used for UV ray crosslinking. The initiator used is conventional compounds such as benzyl methyl ketal, 1-hydroxycyclohexyl phenyl ketone, 2-methyl-1-[4-(methylthio)phenyl]-2-morpholinopropane-1,1-(4-isopropylphenyl)-2-hydroxy -2-methylpropane-1-one, 2-hydroxy-2-methyl-1-phenylpropane-1-one, or 1-(4-dodecylphenyl)-2-hydroxy-2-methylpropane-1-one.

Additives such as an anti-static agent, a stabilizer, a surface active agent, and an anti-oxidant, or other resins may be blended with the intermediate layer, if required and necessary.

A film thickness of the intermediate layer is usually from 0.05 to 5 μm, and preferably from 0.1 to 3 μm. If the film thickness is less than 0.05 μm, not only a sufficient adhesiveness to the heat-sensitive recording layer or the overcoat layer cannot be obtained but also a printing density (white turbidity) decreases when recording and erasing are repeated at the same place. On the other hand, if the thickness thereof is larger than 5 μm, a heat conductivity to the reversible heat-sensitive recording material layer decreases. Thus, neither of those are preferred.

The overcoat layer is provided on the intermediate layer. The reversible heat-sensitive recording layer deforms by heat and pressure exerted by a heating device such as a thermal head in recording and erasing, and an appearance of the heat-sensitive recording layer markedly deteriorates by repeated printing on the same place. In order to prevent such deformation, deterioration, print traces in erasing, and sticking in recording and also to endure recycle, the overcoat layer is provided on the intermediate layer. Materials used for such the overcoat layer are organic materials such as silicone resins, acrylic resins, fluorine resins, epoxy resins and urethane resins, or inorganic materials such as $SiO_2$, SiO, MgO, ZnO, $TiO_2$, $Al_2O_3$, AlN, and $Ta_2O_5$. Further, thermosetting, electron beam-curable resins and UV-curable resins may be used for the overcoat layer.

The overcoat layer can be formed by conventional coating method or vacuum deposition method. Where the overcoat layer is formed using the organic material, the thickness thereof is from 0.01 to 10 μm, and preferably from 0.1 to 5 μm. If the thickness is less than 0.01 μm, an effect of the overcoat layer is decreased. On the other hand, if the thickness thereof is more than 10 μm, a heat conductivity in recording and erasing decreases. Thus, neither of them is preferred.

The heat-sensitive recording layer is formed using the respective components described above as follows. A solution having dissolved therein two components of the resin matrix and the organic low molecular weight material is prepared or a solvent which does not dissolve at least one of the organic low molecular weight materials is used to prepare a solution of the resin matrix. The organic low molecular weight material is dispersed in the resulting solution in a form of fine particles and a high boiling solvent is dissolved therein to prepare a dispersion. Those dispersions thus prepared each is coated directly on a magnetic recording layer face or a reverse side of the magnetic card member. Alternatively, the dispersion is coated on a substrate such as plastic plate, a glass plate, a metal plate, paper, or cloth and dried to form the heat-sensitive recording layer. The layer is adhered on a substrate such as a magnetic card member.

A UV ray-curable or electron beam-curable resin without a solvent or which is diluted by a solvent which does not attack the heat-sensitive recording layer, for example, methanol, ethanol, isopropyl alcohol, hexane, toluene, heptane, or xylene, is coated on the heat-sensitive recording layer, followed by irradiation with ultraviolet ray or electron beam to cure the coating to thereby form an intermediate layer.

A resin for overcoating or an inorganic material is coated or deposited on the intermediate layer to form an overcoat layer. If required and necessary, other resin layer may be provided between the heat-sensitive recording layer and the intermediate layer.

The reversible heat-sensitive recording medium of the present invention is preferably used for a magnetic card. In this case, the reversible heat-sensitive recording medium layer can be provided on either a magnetic layer of a card member or the opposite face thereof. Further, the layer can be provided on an entire surface of the card member or on part thereof. In providing the medium layer of the present invention on the magnetic card member, an under coating layer may be provided, if required and necessary, to improve an adhesiveness of the medium layer to the magnetic card member. Furthermore, in order to improve a visibility, a coloring layer or a metal reflection layer of Al, Ag or Sn may be provided between the reversible heat-sensitive recording layer and the substrate.

The magnetic card having such the reversible heat-sensitive recording layer can widely be applied to a highway card, a JR Orange card, various prepaid cards used in department stores and super markets, and a stored fare card.

The present invention will be explained in more detail by reference to the following examples. Unless otherwise indicated, all parts are by weight.

EXAMPLE 1

| | |
|---|---|
| Behenic acid | 7 parts |
| Thiodipropionic acid | 3 parts |
| Vinyl chloride-vinyl acetate copolymer (VYHH, manufactured by UCC) | 25 parts |
| 1,3-Pentadiene polymer | 2 parts |
| Tetrahydrofuran | 120 parts |

A solution prepared using the above ingredients was coated on an aluminum-deposited polyethylene terephthalate film (thickness: 188 mm) with a wire bar at a dry film thickness of 5 μm to obtain a reversible heat-sensitive recording material layer.

The following composition was coated as an intermediate layer on the layer formed above at a dry film thickness of 1 mm, followed by irradiation with an ultraviolet ray of 500 mJ/cm$^2$ to cure the coating layer.

| | |
|---|---|
| Oligoester acrylate (Aronix M-6100, manufactured by Toa Gosei Co., Ltd.) | 50 parts |
| 1,6-Hexanediol diacrylate | 50 parts |
| Benzyl dimethyl ketal (Irgacure 651: Nippon Ciba Geigy Co., Ltd.) | 2 parts |

A coating solution prepared from 50 parts of an acrylic ultraviolet-curable resin (BR-370, manufactured by Asahi Denka Co., Ltd.) and 50 parts of methanol was coated as an overcoat layer at a dry thickness of 1 mm, followed by irradiation with an ultraviolet ray of 500 mJ/cm$^2$ to cure the coating layer. Thus, the heat-sensitive recording medium of the present invention was prepared.

EXAMPLE 2

A heat-sensitive recording medium was prepared in the same manner as in Example 1, except that the following composition was used for the intermediate layer and an ultraviolet ray of 500 mJ/cm$^2$ was irradiated.

| | |
|---|---|
| Oligoester acrylate (Aronix M-6100, manufactured by Toa Gosei Co., Ltd.) | 50 parts |
| Lauryl acrylate | 50 parts |
| 1-Hydroxycyclohexyl phenyl ketone (Irgacure 184: Nippon Ciba Geigy Co., Ltd.) | 2 parts |

EXAMPLE 3

A heat-sensitive recording medium was prepared in the same manner as in Example 1, except that the following composition was used for the intermediate layer and an electron beam of 5 Mrad was irradiated.

| | |
|---|---|
| Oligoester acrylate (Aronix M-6500) | 50 parts |
| 1,6-Hexanediol diacrylate | 50 parts |

EXAMPLE 4

A heat-sensitive recording medium was prepared in the same manner as in Example 1, except that the following composition was used for the intermediate layer and an ultraviolet ray of 500 mJ/cm$^2$ was irradiated.

| | |
|---|---|
| Oligoester acrylate (Aronix M-6100 manufactured by Toa Gosei Co., Ltd.) | 30 parts |
| 1,9-Nonanediol diacrylate | 70 parts |
| Benzyl dimethyl ketal (Irgacure 651: Nippon Ciba Geigy Co., Ltd.) | 2 parts |

COMPARATIVE EXAMPLE 1

A heat-sensitive recording medium was prepared in the same manner as in Example 1, except that the intermediate layer was not provided.

COMPARATIVE EXAMPLE 2

A heat-sensitive recording medium was prepared in the same manner as in Example 1, except that a solution of the following composition was coated at a dry film thickness of 1 mm and dried to form the intermediate layer.

| | |
|---|---|
| Vinyl acetate resin (degree of polymerization: 500) | 10 parts |
| Methanol | 90 parts |

COMPARATIVE EXAMPLE 3

A heat-sensitive recording medium was prepared in the same manner as in Example 1, except that a solution of the following composition was coated at a dry film thickness of 1 mm and dried to form the intermediate layer.

| | |
|---|---|
| Oligoester acrylate (Aronix M-6100 manufactured by Toa Gosei Co., Ltd.) | 95 parts |
| 1,9-Nonanediol diacrylate | 5 parts |
| Benzyl dimethyl ketal (Irgacure 651: Nippon Ciba Geigy Co., Ltd.) | 2 parts |

COMPARATIVE EXAMPLE 4

A heat-sensitive recording medium was prepared in the same manner as in Example 1, except that a solution of the following composition was coated at a dry film thickness of 1 mm and dried to form the intermediate layer.

| | |
|---|---|
| Oligoester acrylate (Aronix M-6100 manufactured by Toa Gosei Co., Ltd.) | 5 parts |
| 1,9-Nonanediol diacrylate | 95 parts |
| Benzyl dimethyl ketal (Irgacure 651: Nippon Ciba Geigy Co., Ltd.) | 2 parts |

Printing and erasing were repeated at the same places of the respective heat-sensitive recording media obtained in Examples 1 to 4 and Comparative Examples 1 to 4 with a thermal head (8 dot/mm, line head) to evaluate a printability, an erasability and an appearance.

The results obtained are shown in the Table below.

The printed and erased densities were measured with an optical reflection densitometer (Macbeth RD-920).

TABLE

| | Initial | | Repeat 100 times | |
|---|---|---|---|---|
| | Printed density | Erased density | Printed density | Erased density |
| Example 1 | 0.53 | 1.52 | 0.55 | 1.50 |
| Example 2 | 0.50 | 1.48 | 0.53 | 1.51 |
| Example 3 | 0.51 | 1.45 | 0.55 | 1.49 |
| Example 4 | 0.51 | 1.50 | 0.53 | 1.51 |
| Comparative Example 1 | 0.48 | 1.51 | 1.02 | 1.34 |
| Comparative Example 2 | 0.49 | 1.49 | 0.52 | 1.42 |
| Comparative Example 3 | 0.50 | 1.47 | 0.43 | 1.32 |
| Comparative Example 4 | 0.55 | 1.48 | — | — |

As is shown above, in Examples 1, 2 and 3, either of the printed and erased densities did not substantially show density change before and after repeating, and deterioration in an appearance such as scratch was not observed at all. Particularly in Example 4, deterioration in the characteristics was not substantially observed even after repeating 200 times. On the contrary, in Comparative Example 1, a printed density was extremely decreased, and scratch and peeling in the overcoat layer were markedly observed. Further in Comparative Example 2, while decrease in the printed density was not substantially observed, a background was unevenly turbid and scratch was observed at a printed part. In Comparative Example 3, a void was generated between the overcoat layer and the heat-sensitive recording layer after repeating, and a printed and erased part was unevenly turbid. In Comparative Example 4, the intermediate layer was not completely cured and therefore an appearance extremely deteriorated, which made it impossible to measure after repeating 100 times.

The reversible heat-sensitive recording materials of the present invention have an excellent adhesiveness between the recording layer and the overcoat layer and an appearance does not deteriorate even after repeatedly recording. Further, the recording layer is not attacked in forming the overcoat layer.

While the invention has been described in detail and with reference to specific embodiments thereof, it will be apparent to one skilled in the art that various changes and modifications can be made therein without departing from the spirit and scope thereof.

What is claimed is:

1. A reversible heat-sensitive recording medium comprising a reversible heat-sensitive recording layer containing a resin matrix and an organic low molecular weight material, and an overcoat layer, wherein an intermediate layer comprising an ultraviolet ray-crosslinkable or electron beam-reversible heat-sensitive recording layer and the overcoat layer;

wherein said ultraviolet ray-crosslinkable or electron beam-crosslinkable resin comprises:

(A) an oligomer, and (B) a di(meth)acrylate monomer containing a long-chain alkylene group having from 4 to 10 carbon atoms in one molecule; and wherein the (A)/(B) weight ratio is from 90/10 to 10/90.

2. The reversible heat-sensitive recording medium as claimed in claim 1, wherein the resin matrix is at least one member selected from the group consisting of vinyl chloride copolymers, vinylidene chloride copolymers, polyvinyl acetal resins, acrylic resins, silicone resins, polystyrenes, styrene-butadiene copolymers, polyacrylates, polycarbonates, polysulfones, aromatic polyamides, phenoxy resins, cellulose resins, and thermosetting resins.

3. The reversible heat-sensitive recording medium as claimed in claim 1, wherein the organic low molecular weight material is at least one of higher fatty acids having 16 or more carbon atoms.

4. The reversible heat-sensitive recording medium as claimed in claim 1, wherein the organic low molecular weight material comprises at least one of higher fatty acids having 16 or more carbon atoms and at least one of a sulfide represented by a formula $HOOC(CH_2)_m—S—(CH_2)_nCOOH$ wherein m and n each represents an integer of 1 to 5.

5. The reversible heat-sensitive recording medium as claimed in claim 4, wherein the weight ratio of the higher fatty acid to the sulfide is from 90:10 to 10:90.

6. The reversible heat-sensitive recording medium as claimed in claim 1, wherein the amount of the resin matrix is from 50 to 1,600 parts by weight per 100 parts by weight of the organic low molecular weight material.

7. The reversible heat-sensitive recording medium as claimed in claim 1, wherein the reversible heat-sensitive recording layer has a thickness of from 1 to 20 μm.

8. The reversible heat-sensitive recording medium as claimed in claim 1, wherein the intermediate layer has a thickness of from 0.05 to 5 μm.

9. The reversible heat-sensitive recording medium as claimed in claim 1, wherein the overcoat layer comprises a silicone resin, an acrylic resin, a fluorine resin, an epoxy resin, an urethane resin, $SiO_2$, SiO, MgO, ZnO, $TiO_2$, $Al_2O_3$, AlN or $Ta_2O_5$.

10. The reversible heat-sensitive recording medium as claimed in claim 1, wherein the overcoat layer has a thickness of from 0.01 to 10 μm.

11. A magnetic card comprising a magnetic card member having provided thereon the reversible heat-sensitive recording medium as claimed in claim 1.

12. The magnetic card as claimed in claim 11, wherein the magnetic card member comprises a substrate having provided thereon a magnetic recording layer.

13. The magnetic card as claimed in claim 12, wherein the reversible heat-sensitive recording medium is provided on the magnetic card member at a magnetic recording layer side or a side opposite the magnetic recording layer.

14. The magnetic card as claimed in claim 13, wherein the reversible heat-sensitive recording medium is provided on a partial or entire surface of the side.

* * * * *